US008783351B2

(12) United States Patent
Lee et al.

(10) Patent No.: US 8,783,351 B2
(45) Date of Patent: Jul. 22, 2014

(54) METHOD AND APPARATUS FOR CEMENTING A WELLBORE

(75) Inventors: Lindsey Lee, Houston, TX (US); Gene Hill, Odessa, MO (US); Eddie Malcolm, Independence, MO (US); Jeffrey A. Stokes, Grain Valley, MO (US)

(73) Assignee: Fike Corporation, Blue Springs, MO (US)

( * ) Notice: Subject to any disclaimer, the term of this patent is extended or adjusted under 35 U.S.C. 154(b) by 0 days.

(21) Appl. No.: 13/165,420

(22) Filed: Jun. 21, 2011

(65) Prior Publication Data

US 2012/0325475 A1 Dec. 27, 2012

(51) Int. Cl.
*E21B 33/14* (2006.01)
*E21B 34/06* (2006.01)

(52) U.S. Cl.
CPC ..... *E21B 34/063* (2013.01); *E21B 33/146* (2013.01)
USPC ..... 166/285; 166/177.4; 166/317

(58) Field of Classification Search
USPC ..... 166/285, 289, 317, 376, 177.4
See application file for complete search history.

(56) References Cited

U.S. PATENT DOCUMENTS

| | | | | |
|---|---|---|---|---|
| 5,109,925 | A | 5/1992 | Stepp et al. | |
| 5,526,878 | A | 6/1996 | Duell et al. | |
| 5,697,442 | A | 12/1997 | Baldridge et al. | |
| 6,397,950 | B1 | 6/2002 | Streich et al. | |
| 6,457,528 | B1 | 10/2002 | Staudt | |
| 7,191,830 | B2 | 3/2007 | McVay et al. | |
| 7,857,052 | B2 | 12/2010 | Giroux et al. | |
| 7,866,392 | B2 | 1/2011 | Rogers et al. | |
| 2004/0016546 | A1* | 1/2004 | Nguyen et al. | 166/289 |
| 2005/0098324 | A1* | 5/2005 | Gano | 166/384 |
| 2007/0068703 | A1* | 3/2007 | Tessari et al. | 175/57 |
| 2007/0272411 | A1 | 11/2007 | Lopez De Cardenas et al. | |
| 2008/0178938 | A1* | 7/2008 | Stokes et al. | 137/68.23 |
| 2009/0151960 | A1 | 6/2009 | Rogers et al. | |
| 2009/0260816 | A1 | 10/2009 | Webb et al. | |
| 2011/0042082 | A1 | 2/2011 | Schultz et al. | |
| 2011/0079390 | A1 | 4/2011 | Themig | |

FOREIGN PATENT DOCUMENTS

| | | |
|---|---|---|
| CA | 2387196 | 11/2002 |

OTHER PUBLICATIONS

The International Search Report and Written Opinion dated Dec. 3, 2012 in corresponding PCT/US2012/039424 filed on May 24, 2012.

* cited by examiner

*Primary Examiner* — Cathleen Hutchins
*Assistant Examiner* — Taras P Bemko
(74) *Attorney, Agent, or Firm* — Hovey Williams LLP

(57) ABSTRACT

A cementing tool (20) capable of being installed in a casing string (10) and configured to selectively permit the flow of cement through one or more ports (34) in the tool is provided. The ports (34) are normally sealed by rupture disc assemblies (36) comprising a rupture disc (62) that can be opened to permit flow of cement through the casing string central bore (32) and into the annulus (14) defined by the casing string (10) and the downhole formation (16). The cementing tool (20) is particularly useful during cementing operations in which the annulus (14) has become blocked by a collapsed portion of the formation by allowing the obstruction (104) to be bypassed and the flow of cement (100) into the annulus to be continued without substantial interruption. Tool (20) may also be used in multistage cementing operations.

32 Claims, 11 Drawing Sheets

METHOD AND APPARATUS FOR CEMENTING A WELLBORE

BACKGROUND OF THE INVENTION

1. Field of the Invention

The present invention is directed toward a cementing tool, a casing string equipped with a cementing tool, and methods of cementing such a casing string. Particularly, the cementing tool is provided with a rupture disc assembly that upon rupture permits cement to flow from the interior of the casing string through the tool sidewall and into the annulus defined by the casing string and downhole formation into which the casing string is run. The cementing tool permits obstructions or voids within the annulus to be bypassed during cementing operations, and allows for multiple-stage cementing operations to be conducted. Further, the cementing tool, if activated during cementing operations, restores the structural integrity of the casing string that might otherwise be lost through the use of other tools or processes.

2. Description of the Prior Art

Surface casing is typically the first casing string run and fully cemented in a well. Surface casing protects fresh water-bearing sands or formations from vertical migration of well fluids that might otherwise contaminate the fresh water carried by these formations. Often too, the well blow out preventer, which is the last line of defense against an uncontrolled well, is secured to the surface casing. Further, surface casing is used to hang off the next string of casing that is run into the well. Given the many functions of surface casing, it is important for the surface casing to be well supported in order to prevent buckling and damage when loaded in this manner.

The purpose of cementing the surface casing is to have a competent sheath of cement to both support and seal around the casing. During cementing operations, cement is introduced into the annulus created between the casing and the formation through which the casing is run. Cement can be introduced into the annulus in a number of ways. One method is "top job" approach wherein cement is directly injected into the annulus from the surface using one or more small diameter pipes pushed down into the annulus. This method may be useful in cementing shallow casing strings, but is not always reliable in that un-cemented pockets can be left in the annulus. Another method involves the circulation of cement down through the center of the casing string and back toward the surface through the annulus. When successfully completed, this method provides a higher degree of confidence that un-cemented pockets have been avoided or minimized. However, the annulus can become obstructed, such as with a collapsed portion of a loose formation which blocks the flow of cement through the annulus. In other instances, cement may be lost from the annulus into the well formation due to the high porosity of the rock or sand that the well bore is drilled through. This loss prevents the cement from reaching the surface and is known as lost circulation or lost returns. In these instances, the casing would need to be perforated above the obstruction or region of lost circulation so that a new flow path for cement into the annulus can be established. This is undesirable as it requires compromising the casing integrity.

Another solution has been proposed involving the use of differential valve (DV) tools. These tools have largely been used as a part of a multistage cementing operation. These tools are typically run where the cementing is planned to be placed in multiple lifts in a single string of pipe. The bottom section of casing is cemented normally. Then the tool is opened and drilling mud is circulated. After the bottom stage of cement has been set sufficiently, the top stage is cemented through the DV tool. These tools are disadvantageous in that the cementing must be performed in stages, rather than in a single pour, thus adding additional operating time to the cementing process. Further, these tools tend to be expensive and most require some kind of actuation operation, and then be drilled out once the cementing stage is completed.

SUMMARY OF THE INVENTION

The present invention overcomes a number of the difficulties associated with prior apparatus and methods for cementing a casing string by utilizing a cementing tool that couples adjacent casing sections and comprises an integral rupture disc assembly that can be selectively actuated so as to bypass obstructions in the annulus between the downhole formation and casing string or permit flow of cement into the annulus at a desired elevation.

According to one embodiment of the present invention, there is provided a cementing tool configured for attachment to a casing string. The cementing tool comprises a tubular body including a cylindrical sidewall having an interior surface and an exterior surface. The sidewall interior surface defines a central passage therethrough. At least one channel-forming member is provided that defines a channel located outboard from the central passage. The channel includes at least one open end. At least one port is formed in the sidewall that defines a path for fluid flow between the central passage and the channel. The cementing tool further comprises at least one rupture disc assembly comprising a rupture disc that, in its unruptured state, is disposed in fluid blocking relationship between the central passage and the at least one open end.

According to another embodiment of the present invention, there is provided a casing string that comprises at least one section of casing having a central bore and a cementing tool as described herein attached to one end of the section of casing.

According to yet another embodiment of the present invention, there is provided a method of cementing a casing string in a well. The method comprises positioning a casing string comprising a central bore and at least one cementing tool as described herein in a downhole formation. Next, cement is injected downhole through the casing string central bore and cement is caused to flow into an annulus located between the casing string and the formation.

DETAILED DESCRIPTION OF THE PREFERRED EMBODIMENT

Figure 1:
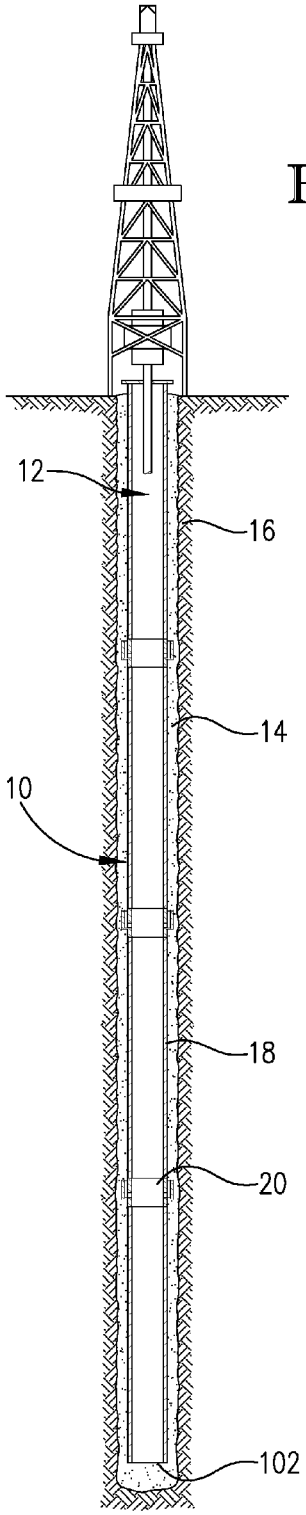
FIG. 1 is a schematic representation of a casing string comprising a plurality of cementing tools disposed in a well bore.

The present invention provides apparatus and methods that are particularly suited for the running in and cementing of a casing string into a well bore. As illustrated in FIG. 1, a casing string 10 has been run into a well bore 12 and cemented into place by filling the annulus 14 defined by casing string 10 and the downhole formation 16 with cement. In particular, casing string 10 comprises a plurality of casing sections 18 interconnected with a plurality of cementing tools 20, which are described in greater detail below. As shown in the illustrated embodiment, cementing tools 20 are positioned within casing string 10 across a variety of elevations within downhole formation 16. As explained below, the precise location of cementing tools 20 can be determined as a matter of general procedure or customized depending upon the downhole formations encountered when creating the well bore.

Figure 2:
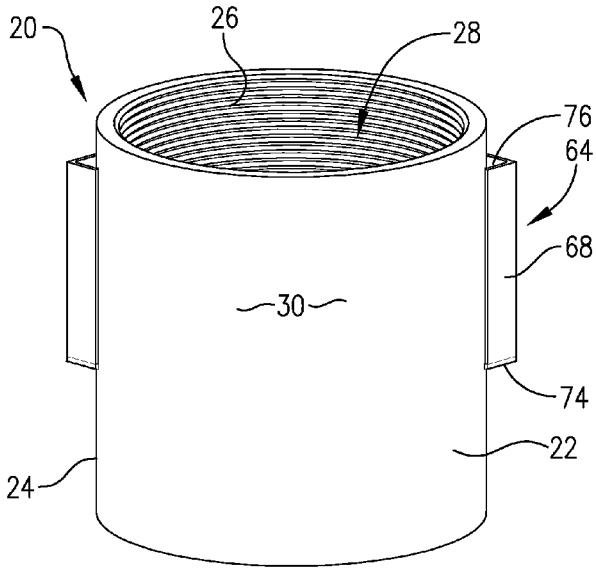
FIG. 2 is a perspective view of a cementing tool according to one embodiment of the present invention.
Figure 3:
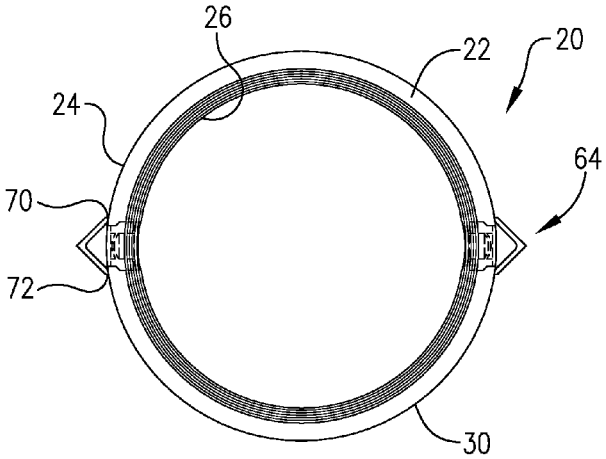
FIG. 3 is a top view of the cementing tool of FIG. 2.
Figure 4B:
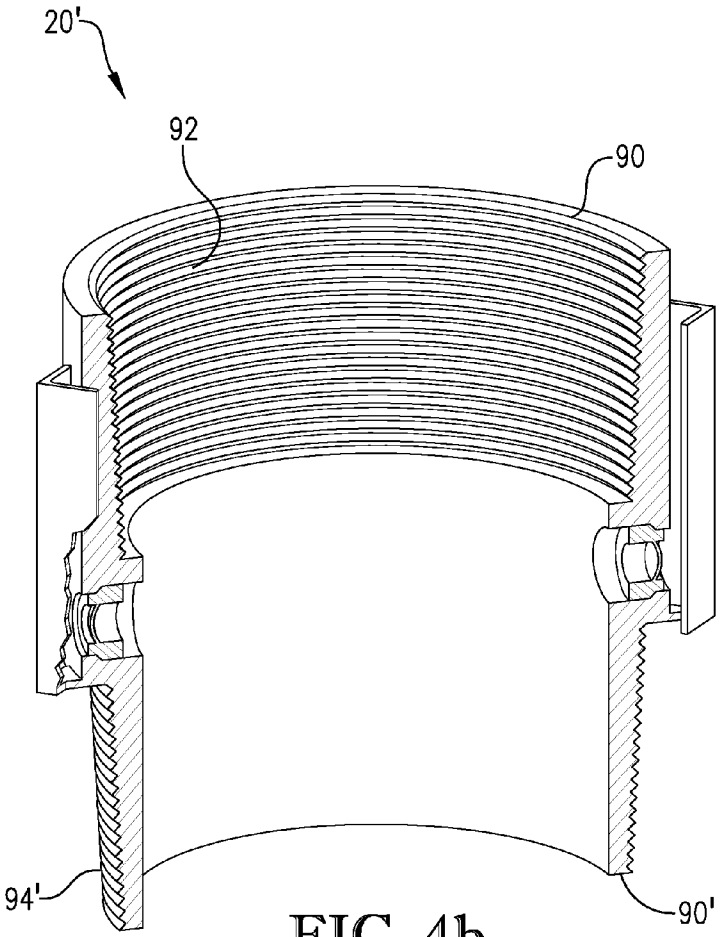
FIG. 4*b* is a cross-sectional view of an alternate embodiment of a cementing tool being equipped with male and female threaded connector structure.
Figure 4A:
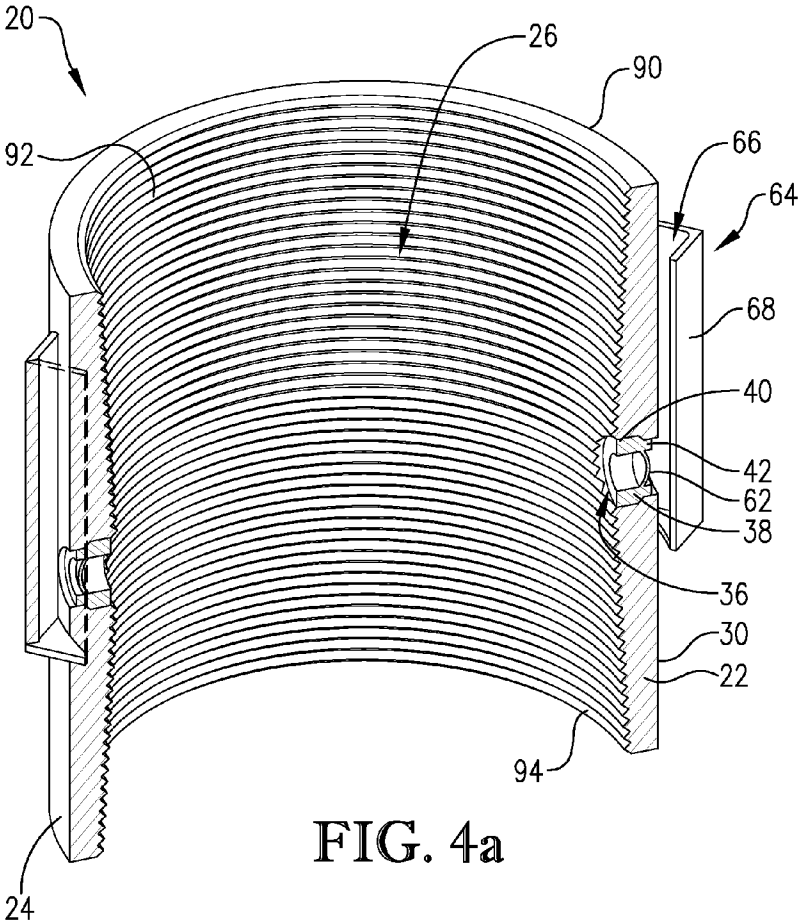
FIG. 4*a* is a cross-sectional view of the cementing tool of FIG. 2.
Figure 6A:
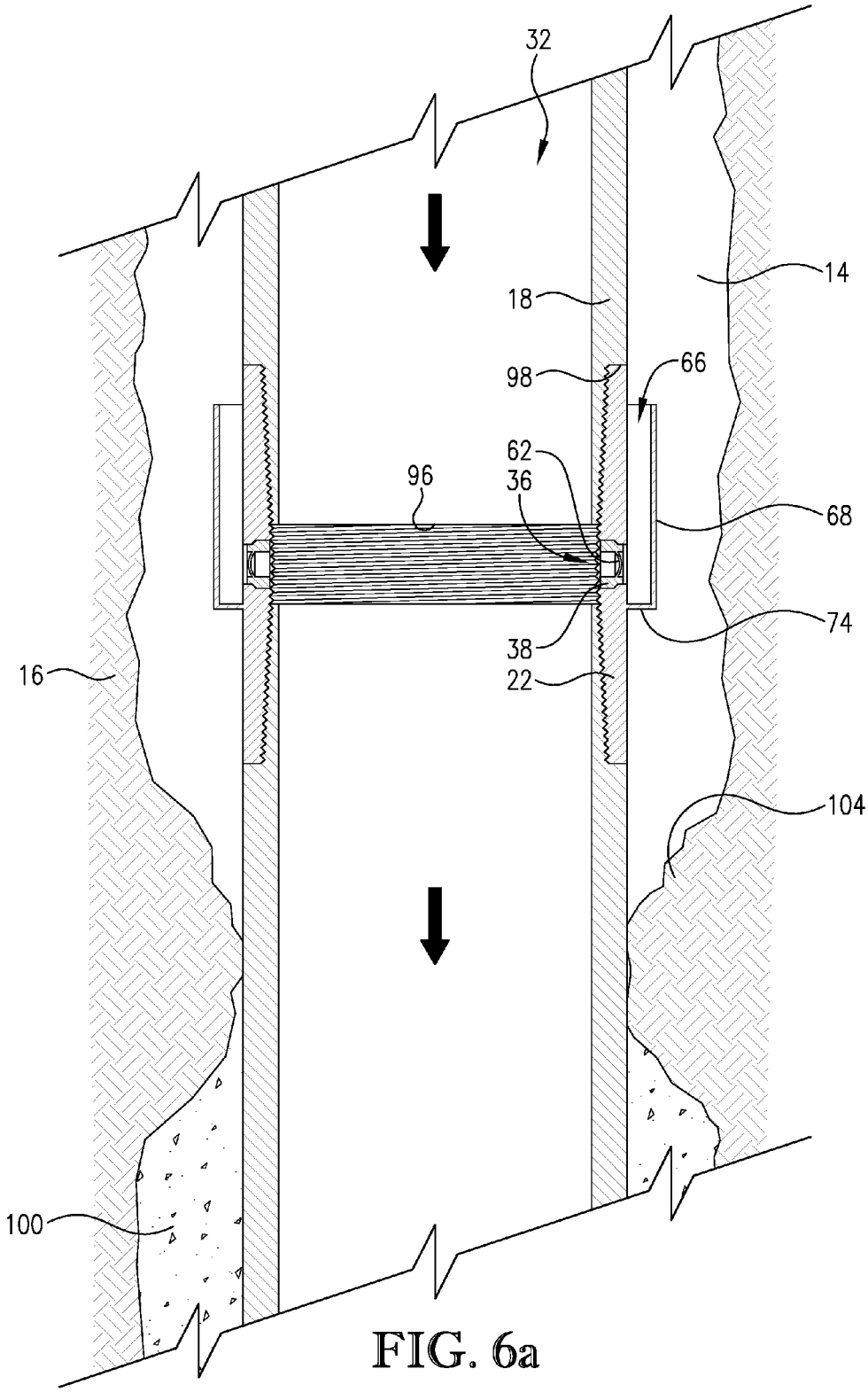
FIG. 6*a* is a cross-sectional view of a section of the well bore wherein the annulus between the downhole formation and casing has been obstructed.
Figure 6B:
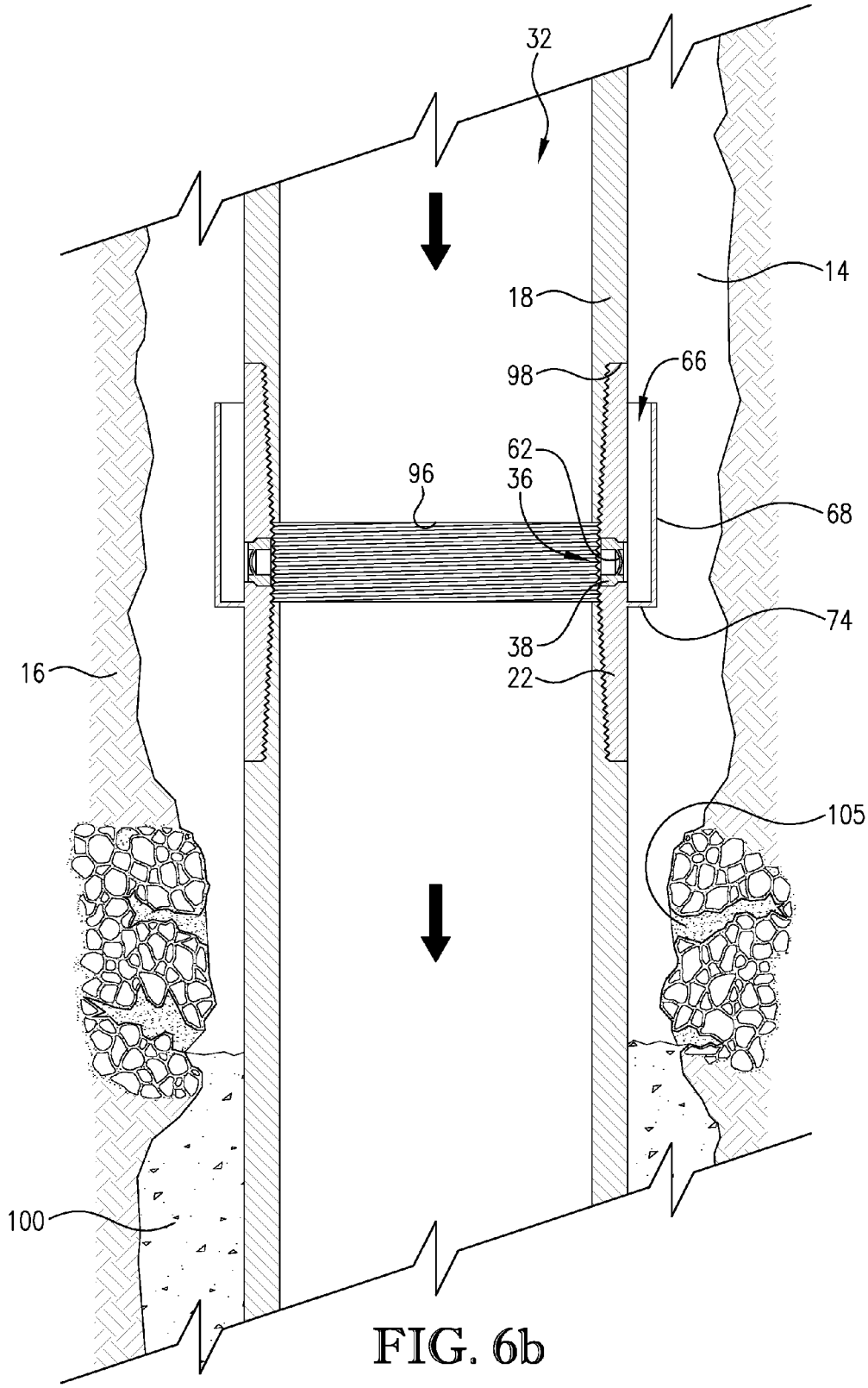
FIG. 6*b* is a cross-sectional view of a section of the well bore wherein a void region of lost circulation has been encountered.
Figure 7A:
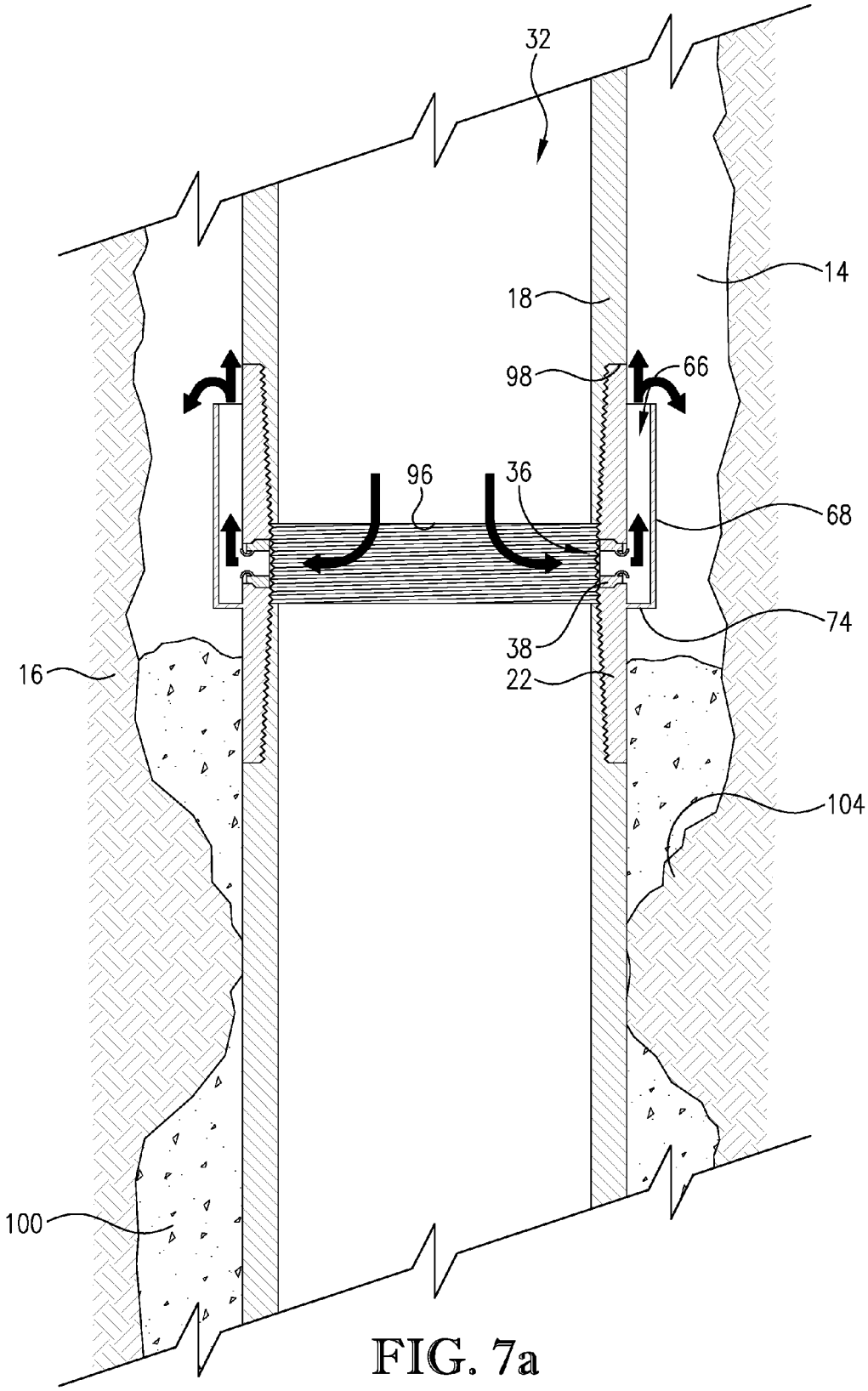
FIG. 7*a* is a cross-sectional view of a section of the well bore containing an obstruction wherein the rupture discs carried by the cementing tool have been ruptured and the flow of cement in the annulus is resumed above the obstruction.
Figure 7B:
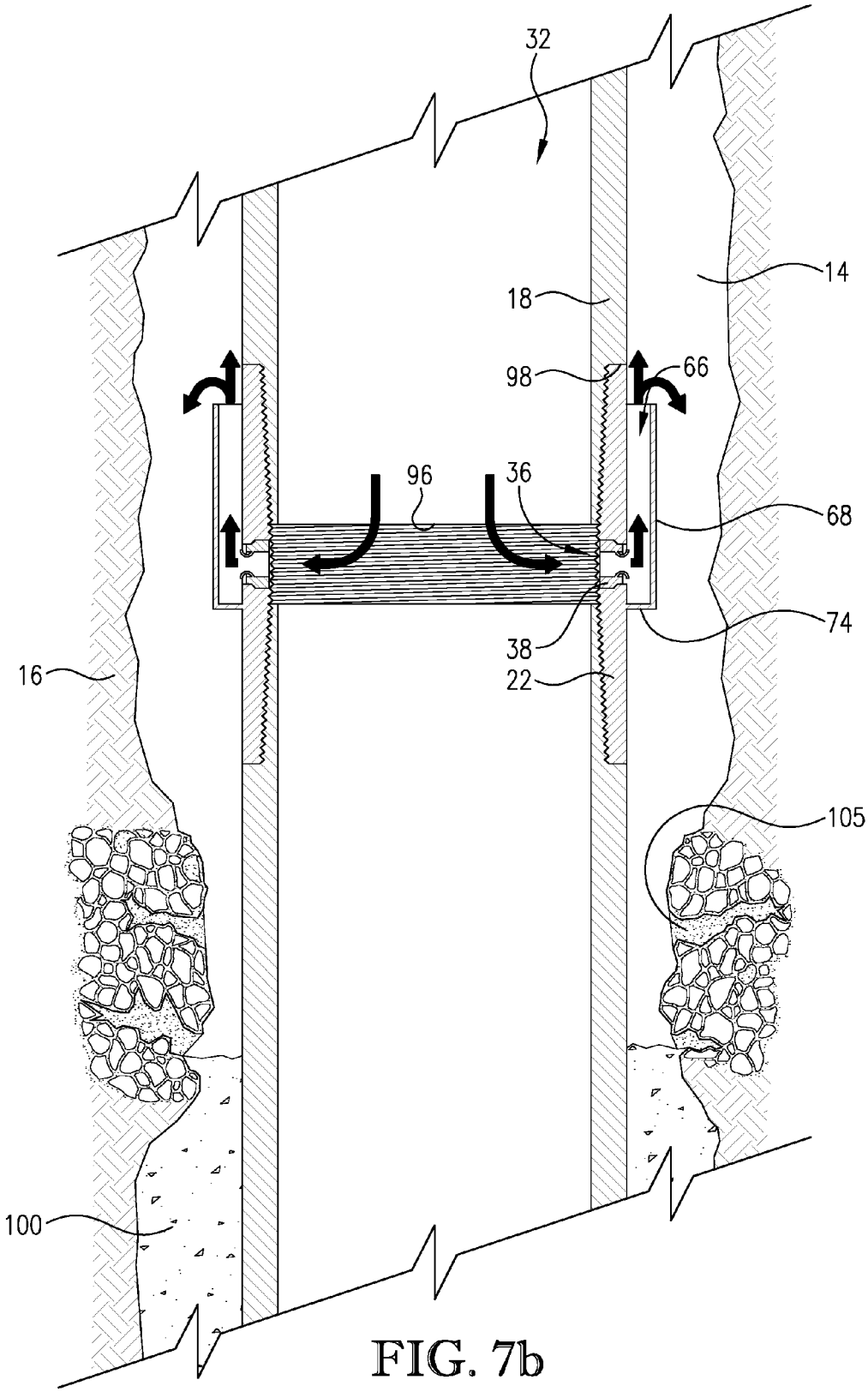
FIG. 7*b* is a cross-sectional view of a section of the well bore containing a void region wherein the rupture discs carried by the cementing tool have been ruptured and the flow of cement in the annulus is resumed above the void region.

Turning next to FIGS. 2-4, one embodiment of a cementing tool 20 in accordance with the present invention is illustrated. Generally, cementing tool 20 comprises a tubular body 22 having a cylindrical sidewall 24. In certain embodiments, tool 20 comprises a collar or coupler that is easily inserted between adjacent casing sections. In other embodiments, tool 20 can be formed from other materials such as mechanical tubing, which may exhibit lengths much greater than that of a collar and have both male and female threaded ends. In the Figures, tool 20 is generally depicted as a collar for ease of illustration; however, this should not be taken as limiting the scope of the present invention. Sidewall 24 comprises an interior surface 26, which defines a passageway 28, and an exterior surface 30, which cooperates with downhole formation 16 to define annulus 14. When installed within casing string 10, passageway 28 is in registry with the central bore 32 of the casing string. Thus, central bore 32 is substantially concentric with tubular body 22. In certain embodiments, such as shown in FIG. 6, passageway 28 and central bore 32 have essentially the same internal diameter.

Sidewall 24 also comprises at least one port 34, and in the embodiments illustrated two ports, formed therein that extend between interior surface 26 and exterior surface 30. Thus, port 34 defines a fluid flow path between the interior and exterior of tool 20 that is substantially perpendicular to the flow path through tool 20 defined by passageway 28.

Figure 5:
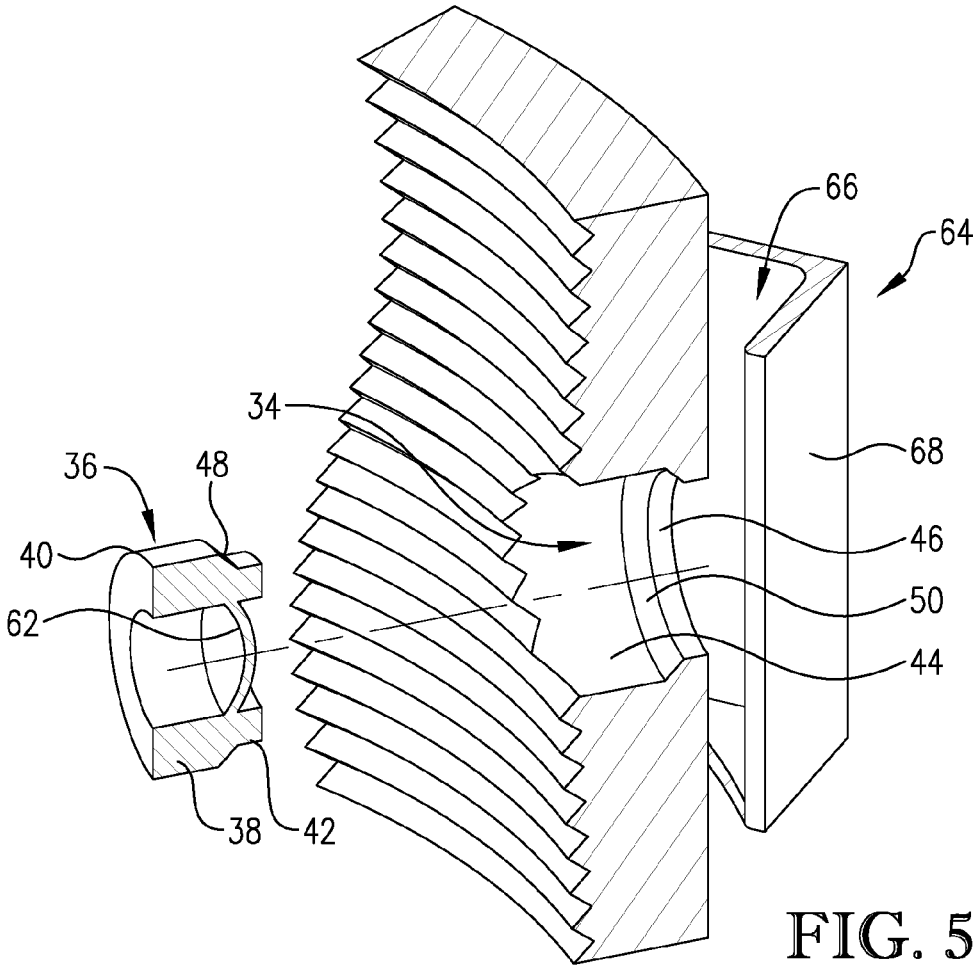
FIG. 5 is a fragmented, cross-sectional view of the port and rupture disc assembly of cementing tool of FIG. 2.

In each port 34, a respective rupture disc assembly 36 is received and secured to sidewall 24. In the embodiment illustrated in FIG. 5, assembly 36 comprises a fitting 38 that is press fitted into port 34 and includes a first cylindrical portion 40 and a second cylindrical portion 42. First cylindrical portion 40 generally has a larger diameter than second cylindrical portion 42. Portions 40 is sized and configured to be received into an inboard portion 44 of port 34, and portion 42 is sized and configured to be received in an outboard portion 46 of port 34. First cylindrical portion 40 is connected to second cylindrical portion 42 by a tapered transition region 48 that is configured to abut a similarly configured tapered segment 50 of port 34 when assembly 36 is installed within port 34. As noted above, fitting 38 is press fitted into port 34. Thus, fitting 38 is affixed to and maintained within port 34 by frictional forces.

Figure 9:
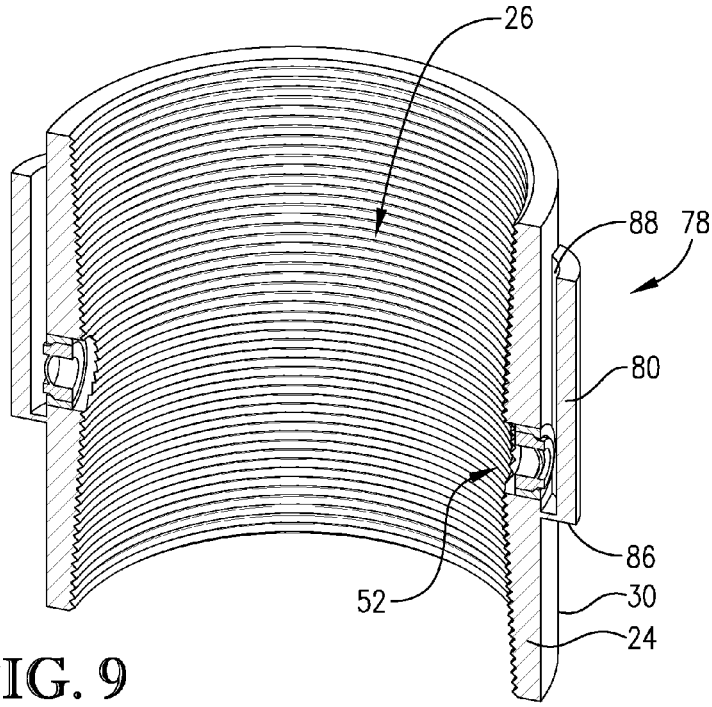
FIG. 9 is a cross-sectional view of the cementing tool of FIG. 8.
Figure 10:
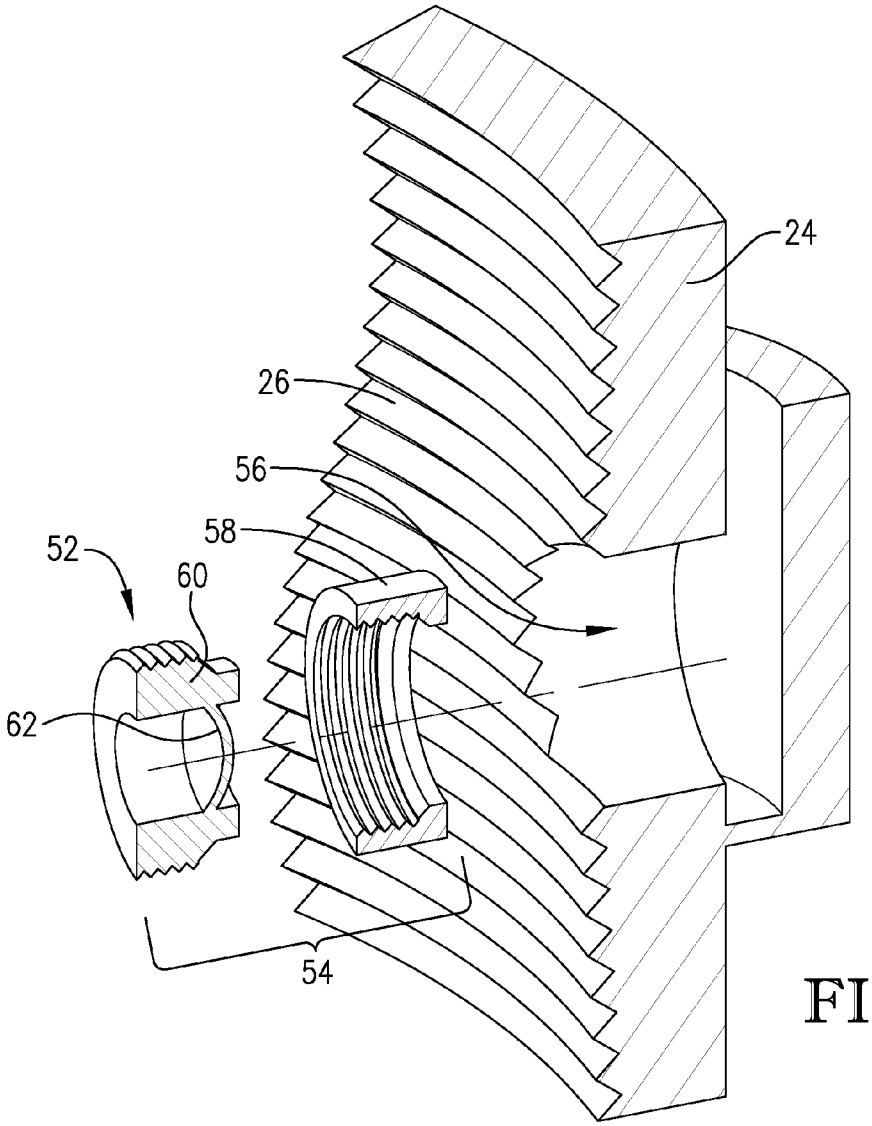
FIG. 10 is a fragmented, cross-sectional view of the port and rupture disc assembly of cementing tool of FIG. 8.

FIGS. 9 and 10 illustrate another embodiment of a rupture disc assembly 52 that comprises a two-part fitting 54 configured to be received in a port 56 formed in sidewall 24. Fitting 54 comprises an internally threaded ferrule 58 that is secured to port 56 and an externally threaded nut 60 configured to be received within ferrule 58. In certain embodiments, ferrule 58 is secured to port 56 by welding, although, it is within the scope of the present invention for ferrule 58 to be secured to port 56 in other ways, such as a threaded connection. In this embodiment, port 56 is of substantially uniform diameter across its entire length, as opposed to port 34 which contains differently sized inboard and outboard portions 44, 46, respectively. It is also noted that rupture disc assembly 52, when installed in port 56, lies substantially flush with interior surface 26, whereas in the embodiment illustrated in FIG. 4, rupture disc assembly 36 extends inwardly beyond interior surface 26, although this does not necessarily need to be the case.

Both rupture disc assembly embodiments 36, 52 comprise a rupture disc 62. In the embodiment illustrated in FIG. 5, rupture disc 62 is affixed to fitting 38, and in the embodiment illustrated in FIG. 10, rupture disc 62 is affixed to nut 60. Rupture disc 62 may be affixed to its respective supporting structure by welding or any other means known to those of skill in the art. Alternatively, rupture disc 62 could be commonly machined from, and thus unitarily formed with, fitting 38 or nut 60. In both illustrated embodiments, rupture disc 62 functions, in its unruptured state, to block the flow of fluid through ports 34, 56, respectively. Rupture disc 62 may also comprise structures that help define its opening characteristics, such as a line of weakness (not shown).

Cementing tool 20 also comprises at least one channel-forming member 64 secured to the sidewall exterior surface 30. Member 64 cooperates with sidewall exterior surface 30 to define a channel 66 that, upon rupture of rupture disc 62, is in fluid communication with the interior of tubular body 22. As shown, channel 66 is longitudinal with respect to tool 20, however, it is within the scope of the present invention for channel 66 to be oriented about different axes. As shown in FIGS. 2-5, channel-forming member 64 comprises an elongated segment 68 having spaced apart, longitudinal end margins 70, 72, each of which are secured to sidewall exterior surface 30. Elongated segment 68 comprises a generally V-shaped cross-sectional profile. In certain embodiments according to the present invention, channel-forming member 64 comprises a sealed end 74 and an open end 76. As shown, channel 66 is substantially unobstructed thereby permitting, upon rupture of rupture disc 62, free flow of a fluid or material from passageway 28 through port 34, up channel 66 and out of open end 76. However, it is within the scope of the present invention for channel-forming member 64 to include a check valve or other similar device, such as a screen or filter, which inhibits entry of debris or fluid into channel 66 from open end 76. Furthermore, as illustrated in the Figures, channel-forming member 64 is disposed so that sealed end 74 is located closer to port 34 than open end 76, but again, it is within the scope of the present invention for other configurations to be employed.

Figure 8:
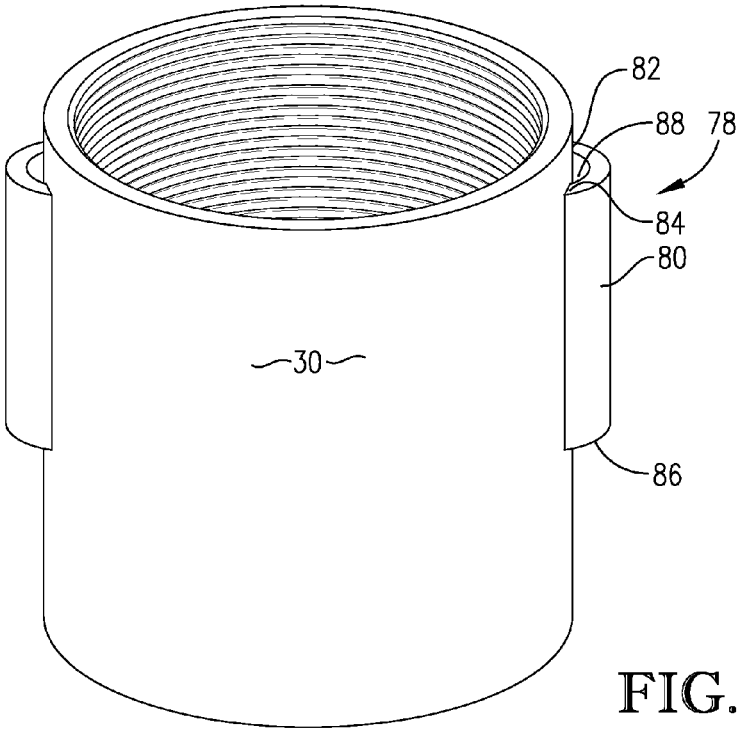
FIG. 8 is a perspective view of a cementing tool according to another embodiment of the present invention.

FIGS. 8-10 illustrate an alternate channel-forming member 78 in accordance with the present invention. Like channel-forming member 64, channel-forming member 78 comprises an elongated segment 80 having spaced apart, longitudinal end margins 82, 84, each of which are secured to sidewall exterior surface 30. Channel-forming member 78 also comprises a sealed end 86 and an open end 88. However, channel-forming member 78 differs from channel-forming member 64 in that it comprises an arcuate cross-sectional profile. In most other respects, channel-forming member 78 and channel-forming member 64 are configured and function similarly.

As noted above, cementing tool 20 is configured to be attached to at least one casing section 18. Tool 20 includes connecting structure 90 to facilitate this attachment. In the embodiment illustrated in FIG. 4*a*, female connecting structure 90 is located at either end of tool 20 and comprises threaded connector sections 92 and 94 configured to mate with corresponding casing section connectors 96 and 98, respectively. In the embodiment illustrated in FIG. 4*b*, tool 20' comprises female/male connecting structures 90, 90', with connector section 94' being in the form of male pipe threads. Further, in particular embodiments according to the present invention, channel-forming member 64, 78 lies entirely outboard of an outer longitudinal margin presented the casing section 18. In other words, channel-forming member 64, 78 lies within the annulus 14 defined by casing string 10 and downhole formation 16.

The use of cementing tool 20 in the cementing of casing string 10 is illustrated in FIGS. 6*a*, 6*b*, 7*a* and 7*b*. In certain embodiments, casing string 10 comprises surface casing, which as noted above, performs a number of important functions. However, it is within the scope of the present invention for casing string 10 to comprise nearly any kind of pipe at any depth run into a well that will function as well casing, including drive pipe, conductor pipe, intermediate casing, drilling liner, production liner, and production casing. Surface casing, generally, can have a diameter of between 8⅝ inches up to 16 inches.

After casing string 10 has been run into downhole formation 16, cement is placed in annulus 14. In certain embodiments this is accomplished by injecting cement through casing central bore 32 toward its lowermost downhole margin 102 at which point the cement is directed into annulus 14 and flows upwardly toward the surface. In an ideal situation, cement continues to flow until the entirety of annulus 14 is filled with cement. However, it can arise that certain portions of downhole formation 16 do not possess sufficient integrity and can collapse around casing string 10 after it is run in, or alternatively a region of lost circulation may be encountered that can present a limitless void. When this occurs, an obstruction 104, or void 105, to the flow of cement 100 in annulus 14 is created. It is understood that the effect of either an obstruction 104 or void 105 is substantially the same in that the flow of cement upwardly through annulus 14 is impeded. Therefore, even though the following discussion is made in terms of encountering an obstruction 104, a void 105 due to a region of lost circulation may be substituted therefor.

Should such an obstruction 104 (or void 105) be detected, the present invention advantageously permits the obstruction (or void) to be bypassed and the introduction of cement 100 into annulus 14 to continue without significant interruptions to the cementing operation, such as the need to pull or run tools downhole. If an obstruction 104 is encountered, the fluid pressure of the cement being pumped downhole may increase. In particular embodiments, the increase in cement pressure is detected by an operator, however, this does not always need to be so. At this point, a rupture disc 62 carried by rupture disc assembly 36, 52 may be ruptured by increasing the pressure of the cement within casing string central bore 32 proximate rupture disc 62 so that the disc opens and cement may flow through port 34, 56 and into the annulus thereby bypassing obstruction 104. If cement returns to the surface are not achieved as expected, the operator may determine that a region of lost circulation has been encountered and the cement is being directed into a porous formation. The operator can then increase the pressure of the cement being flowed down through casing string central bore 32 to open rupture disc 62. In certain embodiments, rupture disc 62 is configured to rupture at a pressure of up to 90% of the rated casing strength. This ensures that disc 62 does not rupture due to normal operating conditions experienced in the well, but rather only in response to encountering an annular obstruction or void during cementing operations. Further, if no obstruction is encountered during cementing operations, rupture disc 62 provides sufficient strength so as not to compromise the overall integrity of casing string 10. As shown in FIG. 7, once ruptured, cement 100 flows from passageway 28 through port 34, into channel 66 and into annulus 14 at a location above the obstruction 104. Thus, avoiding the creation of an annular "void" zone where casings string 10 is unsupported.

Generally, cementing tool 20 should be located within casing string 10 at a higher elevation than obstruction 104. Knowledge of the formations through which the well is being drilled can assist the operator in positioning a cementing tool 20 within casing string 10 in a location that is likely to be at a higher elevation than where an obstruction 104 or void is likely to form. In certain operations, though, it may be difficult to forecast this information. In those situations, a plurality of cementing tools 20 can be periodically installed between casing sections 18 along the length of casing string 10. The frequency of placement of cementing tools 20 can vary depending upon the conditions expected to be encountered in the well, however, in certain embodiments cementing tools can be located within casing string 10 at a spacing of approximately at least every 100 feet, at least every 250 feet, at least every 500 feet, or at least every 1000 ft. Use of a plurality of cementing tools 20 increases the likelihood that at least one cementing tool 20 will be located at a higher elevation than the obstruction, so that the obstruction can be bypassed.

In embodiments which comprise a plurality of cementing tools 20 located within casing string 10, it may be possible for an operator to detect the presence of an obstruction 104 and determine its approximate elevation within annulus 14. Thus, by controlling the pressure within the casing central bore 32, the operator may be able to selectively actuate the rupture disc(s) 62 carried by a particular cementing tool 20, while leaving the other rupture disc(s) of other cementing tools intact. In other embodiments, the pressure of the cement within casing central bore 32 can be adjusted to cause the rupture of all rupture discs 62 within casing string 10, or only those located at elevations above the obstruction 104. In certain embodiments, in order to facilitate this selective rupturing of rupture discs 62, rupture discs of differing burst characteristics may be employed throughout casing string 10.

In other embodiments of the present invention, the bursting pressure of rupture discs 62 may be selected to automatically rupture upon encountering elevated pressures within central bore 32 that attributable to the encountering of an obstruction 104 to prevent damage to the casing. In these embodiments, actual detection and identification of the location of an obstruction is obviated and cementing operations may continue without any meaningful interruption in the flow of cement into annulus 14.

In still other embodiments, a plurality of cementing tools 20 may be employed so as to carry out multistage cementing operations. In certain instances it may be desirable to selectively cement only certain elevations of the casing string 10. For example, wells with low formation pressures may not be able to sustain the hydrostatic forces of a full column of cement. In other applications, it may be desirable to isolate certain sections of the wellbore or use different blends of cement in the wellbore. Still, in cementing deep, hot holes, cement pump times can be limited so as to prevent full-bore cementing of the casing string during a single stage. In these examples and other situations, it may be desirable to cement casing string 10 in two or more stages.

Typically the stage cementing operation begins as described above in that cement 100 is run cement through casing central bore 32 toward its lowermost downhole margin 102 at which point the cement is directed into annulus 14 and flows upwardly toward the surface. Even though an obstruction or void may not be encountered, once the cement has reached a desired height in annulus 14, the flow of cement is stopped. At this point, it may no longer be possible to resume the flow of cement in annulus 14 by flowing cement down to the lowermost margin 102 and back toward the surface. Instead, the operator can actuate rupture discs 62 at a desired elevation so that the flow of cement into annulus 14 can resume, thus beginning a second stage of cementing. This process can be repeated as necessary or desired.

Once cementing operations have been completed, drilling within the well can be continued by merely drilling out the cement within casing string central bore 32. There are no tools that need to be drilled out along with the cement. Alternatively, once cementing or a cementing stage is completed, any cement remaining within central bore 32 can be pumped or circulated out prior to fully curing so that the step of drilling through cement can be avoided.

Figure 11:
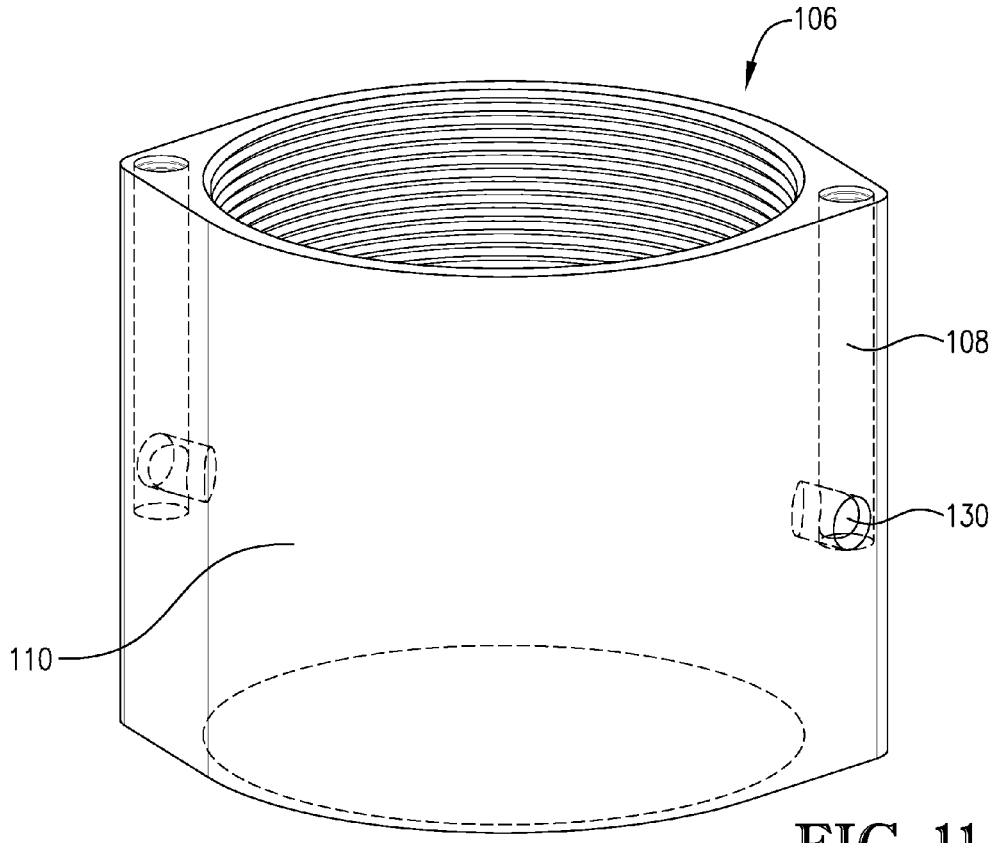
FIG. 11 is a perspective view of a cementing tool according to yet another embodiment of the present invention.
Figure 12:
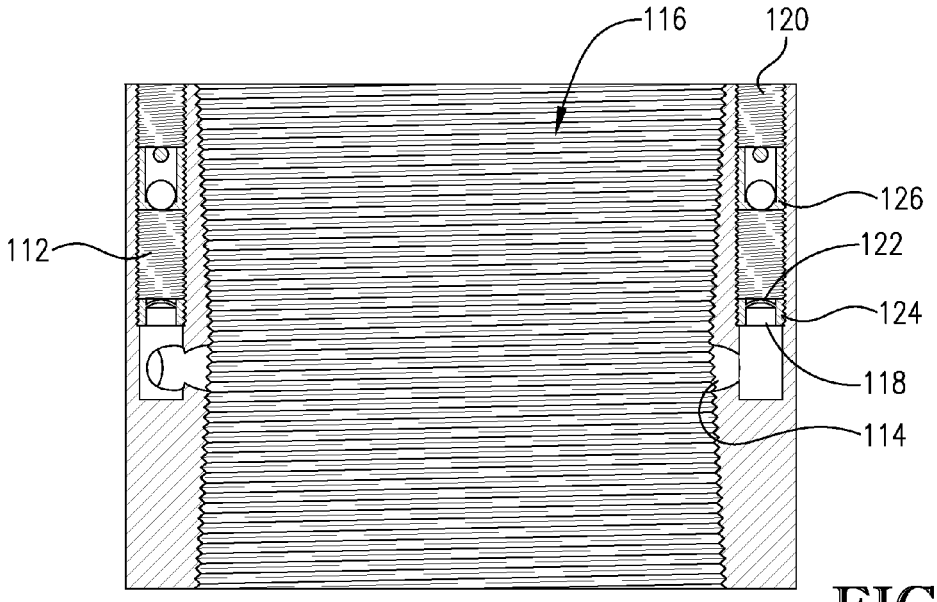
FIG. 12 is a cross-sectional view of the cementing tool of the cementing tool of FIG. 11.
Figure 13:
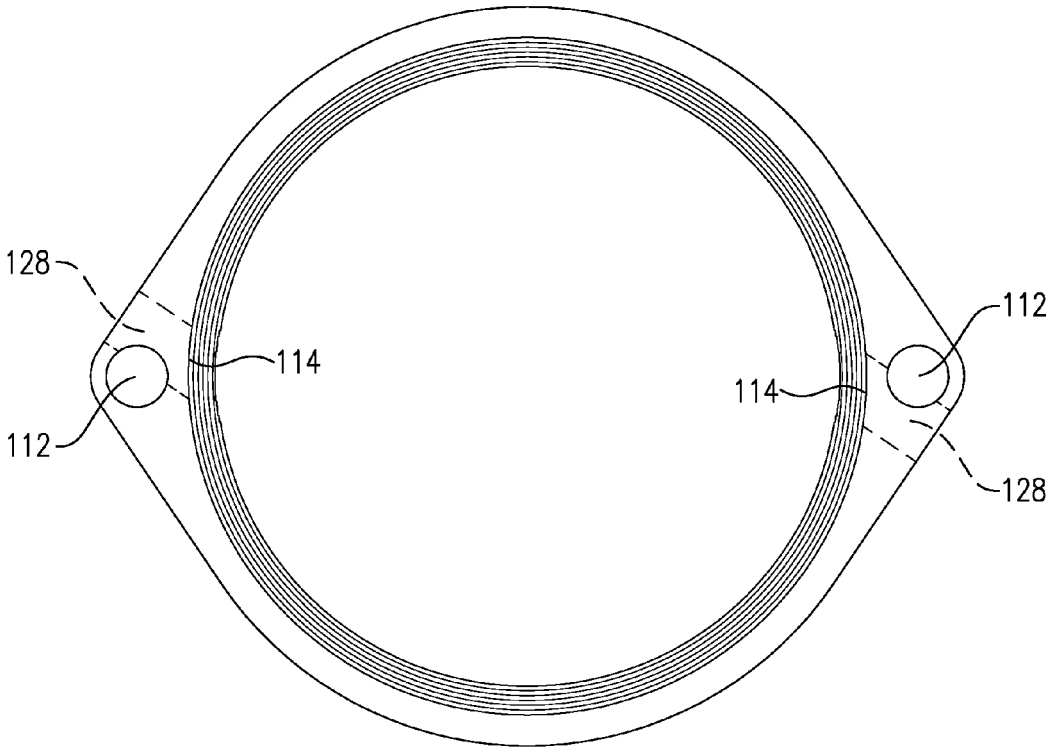
FIG. 13 is a top view of the cementing tool of FIG. 11.

FIGS. 11-13 illustrate another cementing tool embodiment according to the present invention. A cementing tool 106 is illustrated having a pair of channel-forming members 108 that are integrated with tool sidewall 110. Cementing tool 106 shares certain structural and functional characteristics with the embodiments of cementing tool 20 discussed above. However, the most notable differences concern the configuration of channel forming members 108 and the placement of the rupture disc assembly 118. Channel-forming members 108 comprise thickened regions of sidewall 110 that have channels 112 formed therein. In certain embodiments, channels 112 comprise generally circular, longitudinal bores, primarily for ease of machining, but other configurations and orientations for channels 112 also may be used. A port 114 is formed in sidewall 110 which enables fluid communication between tool central passage 116 and channel 112. Thus, a flow path between the interior of tool 106 and the downhole annulus is established.

A rupture disc assembly 118 is positioned within channel 112 in normally fluid blocking relationship between port 114 and a channel outlet 120. Rupture disc assembly 118 includes a rupture disc 122 and may be configured similarly to rupture disc assemblies 36, 52 discussed above. In one embodiment, rupture disc assembly 118 is threadably received and secured into a corresponding threaded portion 124 of channel 112. When in its unruptured state, rupture disc 122 prevents fluid or cement being flowed through tool passage 116 from passing through channel out let 120 and into the downhole annulus. An optional check valve 126 may be installed toward outlet 120 to prevent fluid being circulated within the annulus or other material from entering channel 112 and interfering with the operation of rupture disc assembly 118.

In one embodiment, port 114 is formed by machining a bore 128 through channel-forming member 108 and sidewall 110 until central passage 106 is reached. Likewise, channel 120 may be formed by machining a bore through channel-forming member 108 that is perpendicular to bore 128. The orifice 130 in channel forming member 108 can later be plugged.

The installation and operation of cement tool 106 is similar to that described above with respect to cement tool 20.

The following description sets for exemplary embodiments according to the present invention. It is to be understood, however, that these examples are provided by way of illustration and nothing therein should be taken as a limitation upon the overall scope of the invention.

We claim:

1. A cementing tool configured for attachment to a casing string and operable to direct a fluid flowing within said casing string into an annulus defined between said casing string and a downhole formation, said tool comprising:

a tubular body comprising a cylindrical sidewall having an interior surface and an exterior surface, said sidewall interior surface defining a central passage;

at least one channel-forming member defining a channel that is located outboard from said central passage and has a longitudinal central axis different from that of said central passage, said channel having at least one open end comprising an opening that is longitudinal central axis transverse to said channel permitting communication between said channel and annulus when said tool is interposed between adjacent sections of casing string;

at least one port formed in said sidewall that defines a path for fluid flow between said central passage and said channel; and at least one rupture disc assembly comprising a rupture disc, said rupture disc when in an unruptured state being disposed in fluid blocking relationship between said central passage and said at least one open end.

2. The cementing tool according to claim 1, wherein said at least one channel forming member is secured to said exterior sidewall surface and cooperates with said exterior sidewall surface to define said channel.

3. The cementing tool according to claim 1, wherein said at least one port extends between said interior and exterior sidewall surfaces.

4. The cementing tool according to claim 1, wherein said rupture disc assembly is received in said at least one port and secured to said sidewall.

5. The cementing tool according to claim 1, wherein said rupture disc assembly is located within said channel.

6. The cementing tool according to claim 1, wherein said at least one channel-forming member comprises an elongated segment having spaced apart, longitudinal end margins, each of said end margins being secured to said sidewall exterior surface.

7. The cementing tool according to claim 6, wherein said elongated segment comprises a V-shaped cross-sectional profile.

8. The cementing tool according to claim 6, wherein said elongated segment comprises an arcuate cross-sectional profile.

9. The cementing tool according to claim 1, wherein said at least one channel-forming member is integrally formed with said sidewall.

10. The cementing tool according to claim 9, wherein said channel comprises a generally circular bore.

11. The cementing tool according to claim 1, wherein said at least one channel-forming member comprises a sealed end.

12. The cementing tool according to claim 1, wherein said at least one rupture disc assembly comprises a fitting onto which said rupture disc is secured.

13. The cementing tool according to claim 12, wherein said fitting is press fitted into said at least one port formed in said sidewall.

14. The cementing tool according to claim 13, wherein said fitting comprises a first cylindrical portion and a second cylindrical portion, said first cylindrical portion being of larger diameter than said second cylindrical portion.

15. The cementing tool according to claim 14, wherein said first cylindrical portion is configured to be received in an inboard portion of said at least one port, and said second cylindrical portion is configured to be received in an outboard portion of said at least one port.

16. The cementing tool according to claim 12, wherein said fitting comprises an internally threaded ferrule that is secured to said at least one port and an externally threaded nut configured to be received within said ferrule and onto which said rupture disc is secured.

17. The cementing tool according to claim 1, wherein said sidewall includes at least two ports formed therein and said tool comprises at least two rupture disc assemblies.

18. The cementing tool according to claim 1, said tubular body comprising opposed end regions having connector structure configured to be mated with a section of casing.

19. A casing string comprising:

at least one section of casing including a central bore; and a cementing tool according to claim 1 attached to one end of said at least one section of casing.

20. The casing string according to claim 19, wherein said casing string comprises a plurality of cementing tools interconnected with a plurality of casing sections.

21. The casing string according to claim 19, wherein said casing central bore is substantially concentric with said cementing tool tubular body.

22. The casing string according to claim 19, wherein said at least one channel-forming member lies entirely outboard of an outer margin presented by said at least one casing section.

23. A method of cementing a casing string comprising:

positioning a casing string comprising at least two adjacent casing sections and at least one cementing tool interposed between said at least two adjacent casing sections in a downhole formation, said casing string also comprising a central bore, said casing string and said formation defining an annulus located therebetween, said cementing tool including:

a tubular body comprising a cylindrical sidewall having an interior surface and an exterior surface, said sidewall interior surface defining a central passage;

at least one channel-forming member defining a channel that is located outboard from said central passage and has a longitudinal central axis different from that of said central passage, said channel having at least one open end comprising an opening that is in a plane transverse to said channel longitudinal central axis permitting communication between said channel and annulus;

at least one port formed in said sidewall that defines, at least in part, a path for fluid flow between said central passage and said annulus; and at least one rupture disc assembly comprising a rupture disc, said rupture disc when in an unruptured state being disposed in fluid blocking relationship between said central passage and said annulus; and injecting cement downhole through said casing string central bore and causing said cement to flow into said annulus.

24. The method according to claim 23, wherein said casing string presents a lowermost downhole margin, and said injecting step comprises injecting said cement through said casing string central bore to said lowermost downhole margin where said cement is directed into said annulus and flows upwardly therein.

25. The method according to claim 23, further including:

rupturing said at least one rupture disc thereby permitting cement to flow through said at least one port and into said annulus.

26. The method according to claim 25, wherein said step of rupturing said at least one rupture disc is performed as a part of a multistage cementing operation.

27. The method according to claim 25, wherein said step of rupturing said at least one rupture disc is an automatic response to the presence of an obstruction to the flow of cement in said annulus.

28. The method according to claim 25, wherein said step of rupturing said at least one rupture disc is performed by increasing the pressure of said cement flowing downhole through said casing string central bore.

29. The method according to claim 23, wherein said step of rupturing said at least one rupture disc results in the flow of cement through said at least one port, into said channel and into said annulus via said at least one open end.

30. The method according to claim 23, wherein said casing string comprises a plurality of said cementing tools located at a plurality of elevations within said downhole formation.

31. The method according to claim 30, there being present an obstruction or void in said annulus, said method further comprising determining an approximate elevation of said obstruction or void, and said rupturing step comprises rupturing at least one rupture disc carried by one of said cementing tools at an elevation above that of said obstruction or void.

32. The method according to claim 31, wherein following rupture of said at least one rupture disc, cement is caused to flow through the opened port of said one cementing tool and into said annulus thereby bypassing the obstruction or void.

* * * * *